United States Patent [19]

Herrin

[11] Patent Number: 4,835,944

[45] Date of Patent: Jun. 6, 1989

[54] CARTON NESTING APPARATUS AND METHOD

[76] Inventor: Robert M. Herrin, 2469 John Young Parkway, Ste. H, Orlando, Fla. 32804

[21] Appl. No.: 115,199

[22] Filed: Nov. 2, 1987

[51] Int. Cl.[4] ..... B31B 13/00; B31B 17/00

[52] U.S. Cl. ..... 53/485; 53/169; 493/906

[58] Field of Search ..... 53/169, 458, 457, 485, 53/462, 173, 170; 493/100, 84, 113, 906, 907, 908

[56] References Cited

U.S. PATENT DOCUMENTS

| | | | |
|---|---|---|---|
| 2,082,565 | 6/1937 | Benoit | 53/169 |
| 2,160,518 | 5/1939 | Reynolds | 53/169 X |
| 2,523,667 | 9/1950 | Palmer et al. | 53/169 |
| 2,966,020 | 12/1960 | Bacsak | 53/169 X |
| 3,818,676 | 6/1974 | Russell et al. | 53/169 X |

*Primary Examiner*—James F. Coan

*Attorney, Agent, or Firm*—Duckworth, Allen, Dyer & Doppelt

[57] ABSTRACT

An apparatus and method for nesting a carton bottom with an open-sided carton top includes a work surface having a first end and a discharge end, and feed stations along the work surface for feeding the carton bottom and top onto the work surface. A conveyor and dog arrangement engages the carton bottom near one feed station and moves the carton bottom in a first direction along the work surface toward the discharge end, with a pair of pivoted flaps along the direction of travel for centering and guiding the carton bottom into a nesting arrangement with the carton top as the carton bottom moves along the direction of travel.

10 Claims, 3 Drawing Sheets

CARTON NESTING APPARATUS AND METHOD

BACKGROUND OF THE INVENTION

The present invention relates to apparatus and methods for handling cardboard cartons and containers, and is specifically adapted to nest a carton bottom with an open-sided carton top.

DESCRIPTION OF THE PRIOR ART

In the packaging of certain types of materials, for example fresh citrus fruit, it is often necessary to initially associate the carton bottom with a carton top, in order that the proper sizes of each are asociated together and required storage area is reduced.

Additionally, there are other applications for nesting one object within a corresponding object into which the first is to be extended.

SUMMARY OF THE INVENTION

The present invention is directed to a carton nesting apparatus, and an asociated method, for nesting a carton bottom with and open-sided carton top, and in which the bottom is dimensioned to closely fit within the top. The apparatus comprises a work surface having a first end and a second, discharge end. Means are provided for feeding a carton bottom onto the work surface at a first feed station toward the first end and for feeding a carton top onto the work surface at a second feed station which is between the first feed station and the discharge end. The top is fed onto the work surface with the open side facing toward the first end, and means are provided for engaging the carton bottom near the first feed station and for moving the bottom in a first direction along the work surface toward the discharge end. Means are further provided for centering the carton bottom during its travel along the work surface in the first direction so that the bottom is aligned with the carton top, whereby the continued travel of the bottom in the first direction causes the bottom to nest with the top. After nesting of the carton top and bottom the nested combination is then moved to the discharge end of the work surface.

In a preferred embodiment of the present invention, the centering means comprises means extending into the open side of the carton top for guiding the carton bottom into the top, and is exemplified by a pair of flaps, each flap mounted along an opposing side of the work surface between the first and second feed stations, with the flaps being pivoted about an axis which is generally normal to the work surface. The forward edge of each carton bottom engages the flaps during movement across the work surface, to thereby center and guide the bottom into the carton top.

In order to facilitate nesting of the carton bottom with the top, the work surface includes a downward step at the second feed station, that step having a dimension approximately equal to (or slightly greater than) the wall thickness of the carton top, whereby the inside of the top is generally level with that portion of the work surface above the step, in order to permit the carton bottom to easily move into, and become nested with the carton top.

In the specific arrangement of the apparatus in accordance with the preferred embodiment, the carton bottom engaging and moving means comprises an endless conveyor alongside the work surface, with a series of upstanding dogs carrier by the conveyor for engaging and pushing the carton bottom along the work surface. Each dog is pivoted to the endless conveyor, in order to reduce damage to the carton bottom being pushed. As the conveyor and dog arrangement pushes the carton bottom into a nesting cofiguration with the carton top, the continued travel of the conveyor and dog forces the nested bottom-top combination across discharge skids and out the discharge end of the apparatus.

DESCRIPTION OF THE PREFERRED EMOBODIMENT

Figure 1:
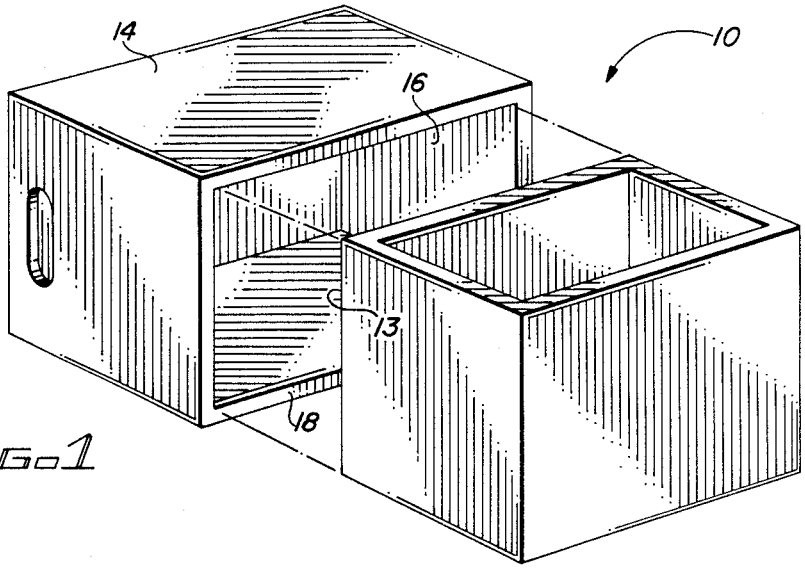
FIG. 1 is a perspective view illustrating a carton top and bottom combination, as those two portions move together for nesting on the apparatus shown in detail in FIGS. 2–4.

Referring first to FIG. 1, there is shown a packaging carton 10 consisting of a carton bottom 12 having a forward edge 13, and a carton top 14. The top 14 includes an open side 16, into which the carton bottom 12 is to be nested. The carton top 14 includes a wall thickness, represented by reference numeral 18. As shown by dotted lines, the botton 12 is dimensioned so as to snugly fit within the inside of the top 14.

Figure 4:
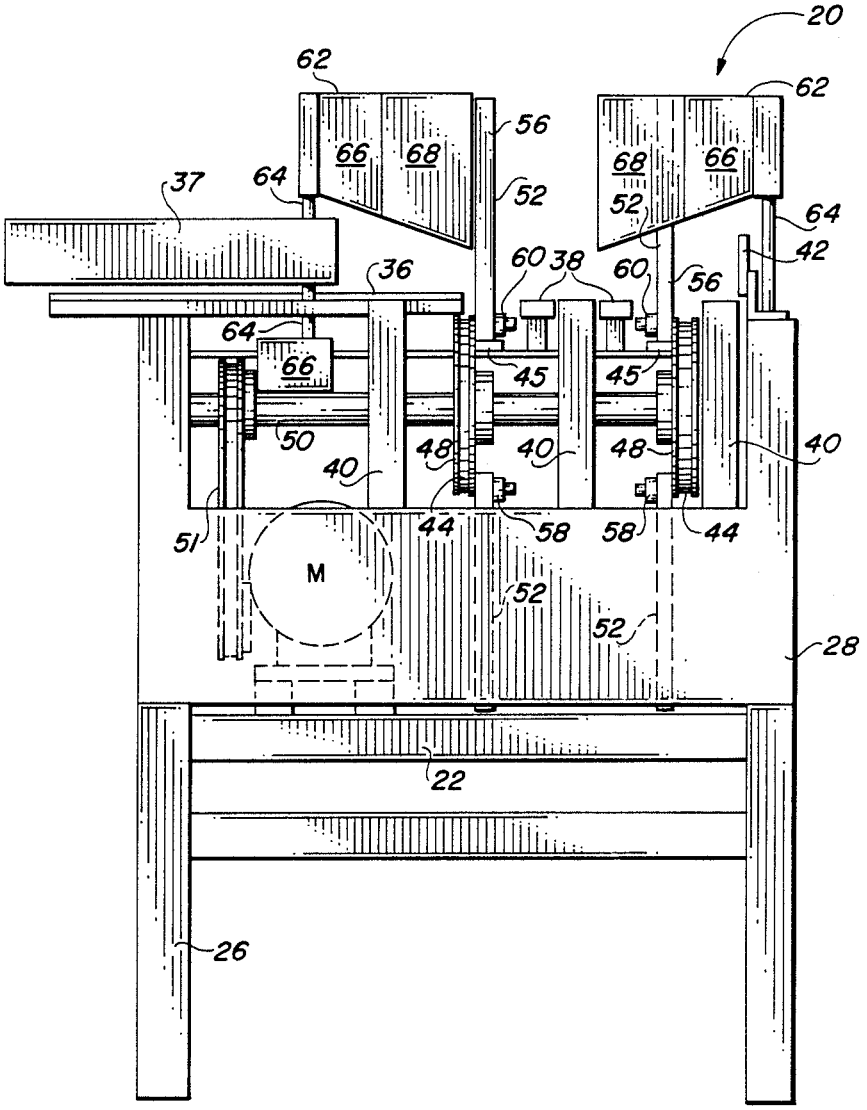
FIG. 4 is a view of the discharge end of the apparatus shown in FIGS. 2 and 3.
Figure 2:
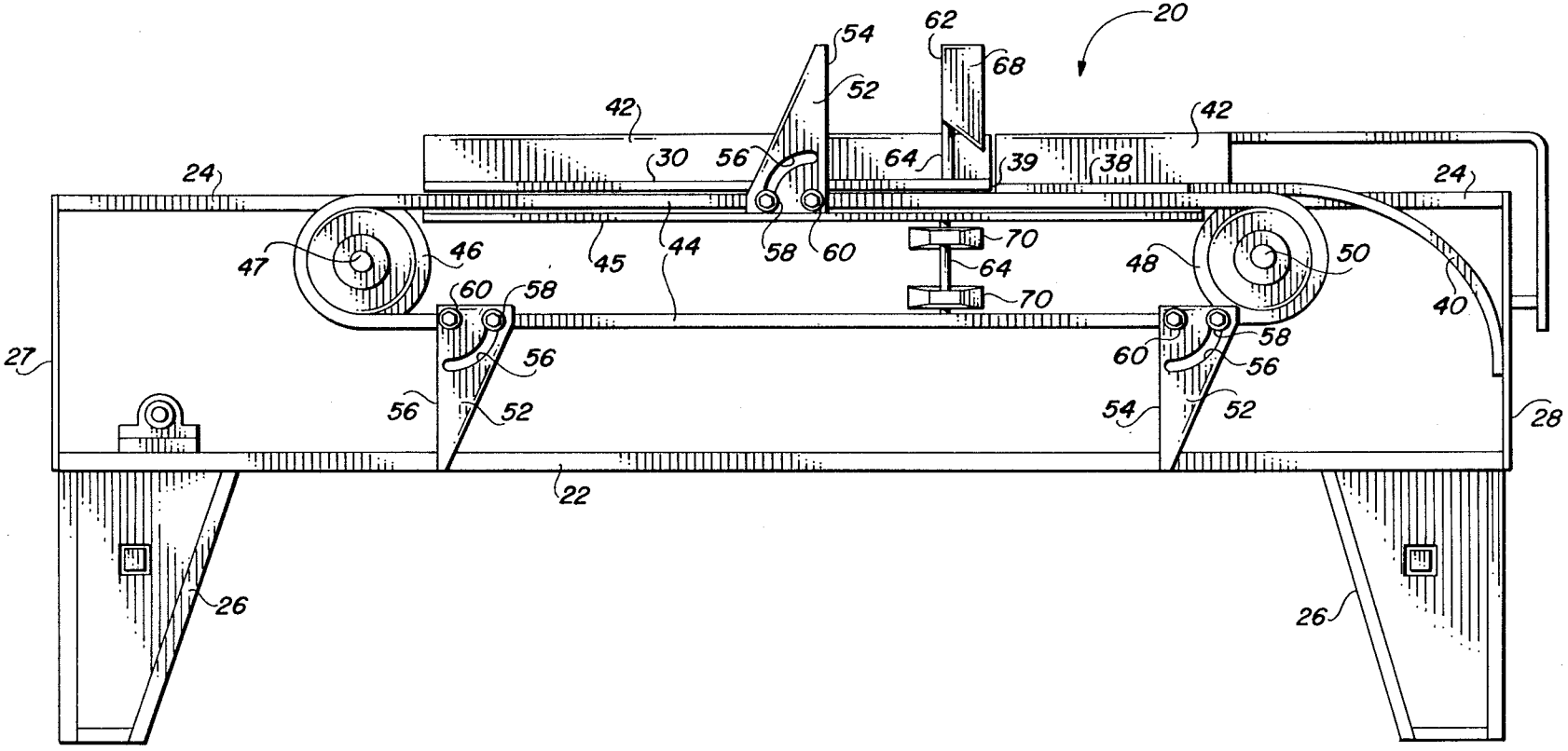
FIG. 2 is a side elevation of the nesting apparatus in accordance with the present invention, with the first end on the left hand and the discharge end on the right hand side.
Figure 3:
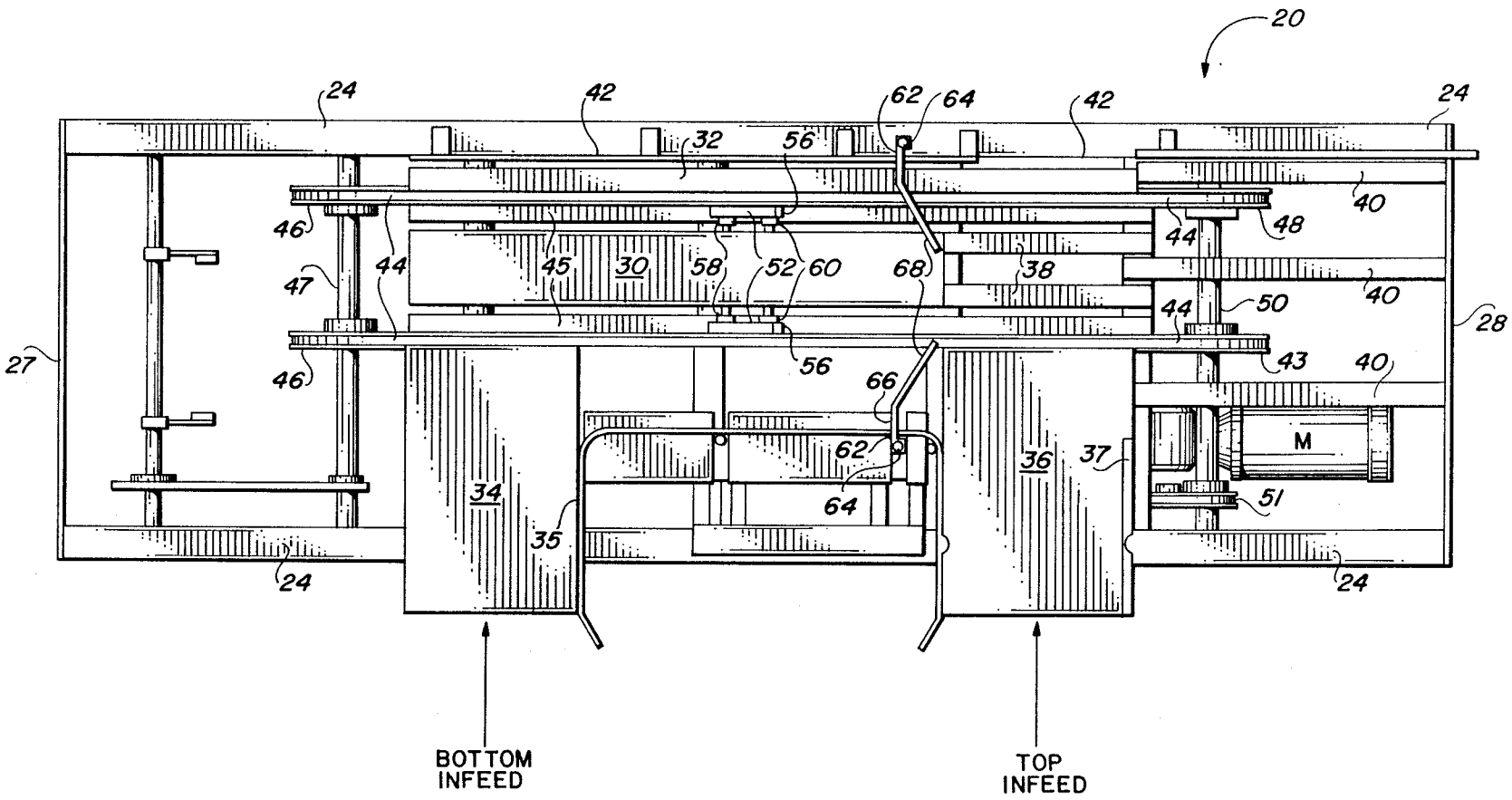
FIG. 3 is a top plan view of the nesting apparatus in accordance with the present invention, with the first end on the left hand side and the second, discharge end on the right hand side.

Reference is now made to FIGS. 2, 3 and 4, for purposes of describing the nesting apparatus in accordance with the present invention.

The nesting apparatus, referred to generally by the reference numaral 20, includes frame members 22 and 24, and support legs 26, a first end plate 27 and a discharge end plate 28 which form a supporting structure for the remainder of the apparatus 20.

The apparatus 20 includes a low friction work surface 30 and spaced side rails 32 lying in the same plane as the work surface 30. To achieve the desired low friction characteristics, nylon or a high density polyurethane is suitable as the work surface material. A first feed station 34 is provided near the first end of the work surface 30, and is intended as an infeed station for carton bottoms. Likewise, a second, carton top infeed station 36 is provided between the bottom infeed station 34 and the discharge end of the work surface 30. Guide rails 35 and 37 associated with the feed stations 34 and 36 insure that the respective carton bottom 12 and carton top 12 pass along the infeed surface and onto the work surface 30 in a direction normal to the direction of travel on the surface 30 between the first end and the discharge end.

That portion of the work surface 30 adjacent the carton top infeed station 36 is defined by a pair of rails 38, which form a downward step 39 (FIG. 2), the dimension of that step being approximately equal to the wall thickeness 18 of the carton top 14 (FIG. 1). This dimension insures that the cardboard bottom 12 will move easily into the cardboard top 14 during nesting, as described in greater detail below.

The apparatus 20 further includes discharge skids 40 near the discharge end of the work surface 30, to receive the nested carton top-bottom combination, and permit that combination to slide downwardly into a storage area (not shown). An upstanding plate 42 along one of the support rails 24 serves as a stop for the carton bottom 12 and carton top 14 passing onto the work surface 30.

The apparatus 20 further includes an endless conveyor, such as a pair of chain link conveyors 44, about supporting end wheels 46 and 48, which are each respectively supported on axles 47 and 50. The wheels 48 serve as drive wheels for the conveyors 44, and are drive by a motor M and drive belt 51.

The apparatus 20 includes means for engaging the carton bottom 12 after being fed across the feed station 34 and onto the work surface 30 and for moving each carton bottom in the first direction along the work surface toward the discharge end. In the arrangement shown in FIGS. 2–4, the carton bottom engaging and moving means comprises plural dogs 52, each of which has a flat, upstanding surface 54 and which is pivoted to the corresponding conveyor 44 via a pivot pin 60. Each dog 52 includes a pivot slot 56 and a pivot pin 58 within the slot 56, to permit each dog to rotate about its own pivot pin 60 and thereby avoid any damage to the nested carton top-bottom combination, as that combination passes across the skids 40 and out the discharge end of the apparatus 20. While adjacent the work surface 30, each dog 52 is maintained in a vertical position through a cam track 45.

The apparatus 20 further includes means for centering and guiding each cardboard bottom 12 during its travel along the first direction and across the work surface 30, so that the bottom 12 is aligned with the corresponding carton top 14, whereby the continued travel of the bottom 12 in the first direction causes the bottom 12 to nest within the corresponding top 14. The centering means also includes means for extending into the open side of the carton top 14 for guiding the carton bottom 12 into that top. In the arrangement shown in FIGS. 2–4, this means includes a pair of flaps 62, each flap extending above the work surface 30 about a pivot rod 64, each rod being attached underneath the work surface 30 to spring and stop mechanism 70, which bias the corresponding flap to a home position, with a first portion 66 of each flap 62 adjacent the pivot rod 64 extending generally transverse to the first direction of travel across the work surface 30 when in the home position, each flap being rotatable to a position generally parallel with the first direction of travel when the carton bottom 12 pushes between the opposing flaps 62. Further, each flap 62 also includes a distal portion 68 angling from the first portion 66 and toward the discharge end 28.

When in operation, a carton bottom 12 is fed across the feed station 34 and onto the work surface 30, abutting the back plate 42. Likewise, a carton top 14 is fed across the feed station 36, onto the work surface rails 38, and against the back plate 42. Because the chain conveyors 44 are below the level of the work surface 30, there is no movement of either the carton bottom 12 or top 14, until such time as the next dog 52 on the conveyors 44 approaches the backside of the carton bottom 12. Thereupon, the surface 54 of both dogs 52 engages the back panel of the carton bottom 12, pushing that bottom across the work surface 30 and onto the side rails 32. As the carton bottom 12 approaches the opposing flap 62, the outermost forward edge 13 of the carton bottom engage the flaps, causing the flaps to rotate about the respective pivot rod 64. The distal portion 68 of the flaps then rotate toward the discharge end, and extend into the open-sided portion of the carton top 14. As the carton bottom 12 is pushed by the dogs 52 through the flaps 62, the flaps center the carton bottom and guide tht bottom into the open side of the carton top 14. Because of the step 39, the inner bottom surface of the carton top 14 is approximately flush with the main portion of the work surface 30, thereby permitting the carton bottom 12 to slide easily into a nesting relationship with the carton to 14.

The chain conveyor 44 and dogs 52 continue to push the carton bottom 12 into the carton top 14, until completely nested therein. Afterwards, the dogs continue to push the carton top-bottom combination across the skids 40, and thence out of the discharge end 28.

It will be understood by those skilled in the art that there has been described above a low cost, facile and novel apparatus and method for nesting carton tops and bottoms.

What is claimed is:

1. A method for nesting a carton bottom with an open-sided carton top in which the bottom is dimensioned to fit closely within the top, comprising the steps of:

feeding a carton bottom onto a work surface at a first feed station near a first end of said work surface;

feeding an open-sided carton top onto said work surface at a second feed station which is between said first feed station and an opposing end of said work surface, said top being fed onto said work surface with the open side thereof facing toward said first end of said work surface;

engaging said carton bottom near said first feed station and moving said carton bottom in a first direction along said work surface toward said opposing end;

providing a pair of flaps, said flaps mounted along opposing sides of said work surface between said first and second feed stations and pivoted about an axis which is generally normal to said work surface, whereby the forward edge of said carton bottom engages said flaps during movement of said bottom therebetween;

centering said carton bottom with said flaps during its travel along said work surface in said first direction, so that said bottom is aligned with said carton top whereby the continued travel of said bottom in said first direction causes said bottom to nest within said top; and after nesting said carton top and bottom, thereafter moving the nested carton top and bottom to the opposing end of said work surface.

2. The method recited in claim 1 further comprising the step of feeding said carton bottom and top onto said work surface in a direction generally transverse to said first direction.

3. Apparatus for nesting a carton bottom with an open-sided carton top in which the bottom is dimensioned to closely fit within the top, comprising:

a work surface having a first end and a second, discharge end;

means for feeding a carton bottom onto said work surface at a first feed station towards said first end thereof;

means for feeding an open-sided carton top onto said work surface at a second feed station which is between said first feed station and said discharge end, said top being fed onto said work surface with the open side thereof facing toward said first end;

means for engaging said carton bottom near said first feed station and for moving said carton bottom in a first direction along said work surface towards said discharge end;

means for centering said carton bottom during its travel along said work surface in said first direction, so that said bottom is aligned with said caron top, said centering means including a pair of flaps, said flaps mounted along opposing sides of said work surface between said first and second feed stations and pivoted about an axis which is generally normal to said work surface, whereby the forward edge of said carton bottom engages said flaps during movement of said bottom therebetween to center and guide said bottom into said carton top, so that the continued travel of said bottom in said first direction causes said bottom to nest within said top; and means, after nesting said carton top and bottom, for thereafter moving the nested carton top and bottom to the discharge end of said work surface.

4. The apparatus recited in claim 1 wherein each flap is biased to a home position, with a first portion of each flap adjacent said pivot axis extending generally transverse to said first direction of travel across said work surface when in said home position, and rotating to a position generally parallel with said first direction of travel when said carton bottom pushes between said flaps.

5. The apparatus recited in claim 4 wherein each flap further includes a distal portion angling from said first portion and toward said discharge end.

6. The apparatus recited in claim 1 wherein said feeding means for said first and second feeding stations comprises means for laterally feeding said carton bottom and top onto said work surface in a direction generally transverse to said first direction.

7. The apparatus recited in claim 1 wherein said carton bottom engaging and moving means comprises an endless conveyor alongside said work surface and having an upstanding dog carried by said conveyor for engaging and pushing said carton bottom along said work surface and into said carton top.

8. The apparatus recited in claim 7 wherein said means for moving after nesting comprises said dog and conveyor.

9. Apparatus for nesting a carton bottom with a open-sided carton top in which the bottom is dimensioned to closely fit within the top, comprising:

a work surface having a first end and a second, discharge end;

means for feeding a carton bottom onto said work surface at a first feed station towards said first end thereof;

means for feeding an open-sided carton top onto said work surface at a second feed station which is between said first feed station and said discharge end, said top being fed onto said work surface with the open side thereof facing toward said first end;

said work surface including a downward step at said second fed station, said step having a dimension approximately equal to the wall thickness of said carton top whereby the inside of said top is generally level with said work surface;

means for engaging said carton bottom near said first feed station and for moving said carton bottom in a first direction along said work surface towards said discharge end;

means for centering said carton bottom during its travel along said work surface in said first direction, so that said bottom is aligned with said carton top, whereby the continued travel of said bottom in said first direction causes said bottom to nest within said top; and means, after nesting said carton top and bottom, for thereafter moving the nested carton top and bottom to the discharge end of said work surface.

10. A method for inserting a packaging element inside an open-sided carton, wherein the package element is dimensioned to fit closely within the carton, comprising the steps of:

feeding the packaging element onto a work surface at a first feed station near a first end of said work surface;

feeding the open-sided carton onto said work surface at a second feed station which is between said first feed station and an opposing end of said work surface, said carton being fed onto to said work surface with the open side thereof facing toward said first end of said work surface;

engaging said packaging element near said first feed station and moving said packaging element in a first direction along said work surface toward said opposing end;

providing a pair of flaps, said flaps mounted along opposing sides of said work surface between said first and second feed stations and pivoted about and axis which is generally normal to said work surface, whereby the forward edge of said packaging element engages said flaps during movement of said bottom therebetween;

centering said packaging element with said flaps during its travel along said work surface in said first direction, so that said packaging element is aligned with said open side of said carton, whereby the continued travel of said packaging element in said first direction causes said packaging element to nest within said carton; and after nesting said packaging element within said carton, thereafter moving the nested packaging element-carton combination to the opposing end of said work surface.

* * * * *